US005924060A

United States Patent [19]

Brandenburg

[11] Patent Number: 5,924,060

[45] Date of Patent: Jul. 13, 1999

[54] DIGITAL CODING PROCESS FOR TRANSMISSION OR STORAGE OF ACOUSTICAL SIGNALS BY TRANSFORMING OF SCANNING VALUES INTO SPECTRAL COEFFICIENTS

[76] Inventor: Karl Heinz Brandenburg, Am Europakanal 40, 8520 Erlangen, Germany

[21] Appl. No.: 08/821,007

[22] Filed: Mar. 20, 1997

Related U.S. Application Data

[62] Continuation of application No. 08/650,896, May 17, 1996, abandoned, which is a continuation of application No. 08/519,620, Sep. 25, 1995, abandoned, which is a continuation of application No. 07/977,748, Nov. 16, 1992, abandoned, which is a continuation of application No. 07/816,528, Dec. 30, 1991, abandoned, which is a continuation of application No. 07/640,550, Jan. 14, 1991, abandoned, which is a continuation of application No. 07/177,550, filed as application No. PCT/DE87/00384, Aug. 29, 1987, abandoned.

[30] Foreign Application Priority Data

Aug. 29, 1986 [DE] Germany ..... 36 29 434

[51] Int. Cl.[6] ..... G10L 3/02

[52] U.S. Cl. ..... 704/200; 704/229; 704/230

[58] Field of Search ..... 704/229, 230, 704/2.91–2.95

[56] References Cited

U.S. PATENT DOCUMENTS

| | | | |
|---|---|---|---|
| 4,184,049 | 1/1980 | Crochiere et al. | 381/37 |
| 4,516,258 | 5/1985 | Ching et al. | 381/31 |
| 4,790,016 | 12/1988 | Mazor et al. | 381/36 |
| 4,802,222 | 1/1989 | Weaver | 381/35 |

FOREIGN PATENT DOCUMENTS

| | | |
|---|---|---|
| 3310480 | 10/1984 | Germany . |
| 8603872 | 7/1986 | WIPO . |

OTHER PUBLICATIONS

Tribolet et al., "Frequency Domain Coding of Speech", IEEE Trans. ASSP., vol. ASSP –27, No. 5, Oct. 1979, pp. 512–530.

Cox et al., "Real–Time Simulation Simulation of Adaptive Transform Coding", IEEE Trans ASSP., vol. ASSP–29, No. 2 Apr. 1981, pp. 147–154.

Crouse et al., "Adaptive Bit Allocation Technique", IBM Tech. Discl. Bull,. vol. 27, No. 2, Jul. 1984, pp. 1003–1007.

Zelenski et al., "Adaptive Transform Coding of Speech Signals", IEEE Trans ASSP, vol. ASSP–25, No. 4 Aug. 1977, pp. 299–309.

Brandenburg et al., "Fast Signal Processor Encodes 48 KHZ/16 Bit Audio into 3 Bit in Real Time", IEEE ICASSP 88, Apr. 1988, pp. 2528–2531.

Brandenburg, "High Quality Sound Coding at 2.5 Bit/Sample", 1988 AES Convention,. Apr. 1988, pp. 1–2582(D2)–14–2582(D2).

(List continued on next page.)

*Primary Examiner*—David R. Hudspeth
*Assistant Examiner*—Michael N. Opsasnick
*Attorney, Agent, or Firm*—Blackwell Sanders Peper Martin

[57] ABSTRACT

A digital coding process for the transmission and/or storage of acoustical signals and, in particular, of musical signals, in which N scanning values of the acoustical signals are transformed into M spectral coefficients. The M spectral coefficients are quantized in the first step. Following encoding, the number of bits required for representation is checked utilizing an optimum encoder. If the number of bits is greater than the prescribed number of bits, quantization and encoding is repeated in further steps until the number of bits required for representation does not exceed the prescribed number of bits, whereby the required quantization level is transmitted or stored in addition to the data bits. Transmission and/or storage of acoustical signals and, in particular, of musical signals is accordingly possible without subjective diminishment of quality of the musical signals while reducing the data rates by factor 4 to 6.

8 Claims, 2 Drawing Sheets

OTHER PUBLICATIONS

Brandenburg, "OCF: Coding High Quality Audio with Data Rates of 64 kBit/SEC", 1988 AES Convention Nov. 1988, pp. 1–2723 (H6) –16–2723 (H6).

Brandenburg, "Low Bit Rate Codes for Audio Signals . . . ", 1988 AES Convention Nov. 1988, pp. 1–2707 (H7) – 11–2707 (H7).

Brandenburg, "OCF –A New Coding Algorithm for High Quality Sound Signalss", IEEE ICASSP 1987.

DIGITAL CODING PROCESS FOR TRANSMISSION OR STORAGE OF ACOUSTICAL SIGNALS BY TRANSFORMING OF SCANNING VALUES INTO SPECTRAL COEFFICIENTS

This application is a continuation of application Ser. No. 08/650,896, filed on May 17, 1996, (now abandoned) which was a continuation of application Ser. No. 08/519,620, filed on Sep. 25, 1995, (now abandoned) which was a continuation of application Ser. No. 07/977,748, filed on Nov. 16, 1992, (now abandoned), which was a continuation of application Ser. No. 07/816,528, filed on Dec. 30, 1991, (now abandoned), which was a continuation of application Ser. No. 07/640,550, filed on Jan. 14, 1991, (now abandoned), which was a continuation of application Ser. No. 07/177,550, filed on Apr. 4, 1991, (now abandoned) as international application serial No. PCT/DE87/00384, filed Aug. 29, 1987, claiming priority to foreign appl. No. P3629434.9, filed Aug. 29, 1986.

BACKGROUND OF THE INVENTION

The present invention relates to a digital coding process for the transmission and/or storage of acoustical signals and, in particular, of musical signals.

STATE OF THE ART

The standard process for coding acoustical signals is the so-called pulse code modulation. In this process, the musical signals are scanned with at least 32 kHz, usually 44.1 kHz. Thus, 16 bit linear coding yields data rates between 512 and 705.6 kbit/s.

In practice, processes for reducing such data volume have not been able to gain ground for musical signals. The best results up to now with coding and data reduction of musical signals have been achieved with so-called "adaptive transformation coding"; in this connection reference is made to DE-PS 33 10 480 and to the contents of which is expressly referred with regard to all particulars, which are not described in more detail. Adaptive transformation coding permits a data reduction of approx. 110 kbits while maintaining good quality.

A disadvantage of this known process, which is the point of departure for the present invention is, however, that a loss of quality can be subjectively perceived, particularly, in the case of critical pieces of music. This can be due to, among other things, that the disturbance part of the coded signal cannot be adapted to the threshold of audibility of the ear in the prior art processes and, moreover, there may be overmodulation or too rough a quantization.

BRIEF DESCRIPTION OF THE INVENTION

The object of the present invention is to provide a digital coding process for the transmission and/or storage of acoustical signals and in particular of musical signals as well as a corresponding decoding process, which permits reducing the data rates by factor 4 to 6 without subjectively diminishing the quality of the musical signal.

In the case of the invented coding process, the data is first transformed in blocks like in the known processes, by way of illustration, by employing "discrete cosinus transformation", the TDAC transformation or a "fast Fourier transformation" into a set of spectral coefficients. A level control may be made beforehand. Furthermore, a so-called windowing may be conducted. A value for the so-called "spectral nonuniform distribution" is calculated from the spectral coefficients. And from this value, an initial value for the level of quantization in the spectral region is determined. In contrast to state of the art processes, as by way of illustration the ATC process, all data in the spectral region are quantized with the thus formed quantization level. The resulting field of integers corresponding to the quantized values of the spectral coefficients are directly encoded with an optimal coder and in particular an entropy coder.

If the overall length of the thus encoded data is greater than of the number of bits available for this block, the quantization level is raised and the encoding is conducted over again. This process is repeated until no more than the prescribed number of bits for the encoding is required.

The additional information transmitted or stored in each block is:

a value for the spectral nonuniform distribution, a variance factor, which is required for encoding with the actual bits available, the number of spectral coefficients quantized to zero.

Furthermore, the value for the actual signal amplitude (level control) must be transmitted in so far as level control has been conducted. The value of this additional information may, to the extent that they are not already integers, be transmitted roughly quantized.

According to one aspect of the invention, an element of the present invention is that both linear quantizers with a fixed or variable quantization level and non-linear, by way of illustration logarithmic or so-called MAX quantizers may be employed. Moreover, special quantizers working with an uneven level number may also be used so that the quantized values are either exactly "0" or may be represented by a sign bit and a coded value of the amount.

The effectiveness of the encoding may be improved for conventional musical signals by means of additional measures:

Toward high frequencies, the spectral coefficients may disappear or become very small. These values may preferably be counted separately and encoded. In this case the number and the kind of encoding of the small values may be transmitted separately.

If all the available bits are not required for encoding the quantized spectral coefficients of a block, the "leftover" bits may be counted to the number of bits of the next block, i.e. a part of the transmission occurs in one block, whereas the transformation of the remaining part occurs in the next block. In this case, the information on how many bits already belong to the next block is, of course, to be transmitted along.

Furthermore the audibilty of the disturbance in critical musical signals may be avoided by reflecting psycho-acoustical findings in the encoding. This possiblity is a substantial advantage of the invented process over other processes:

For this purpose, the spectral coefficients are divided into so-called frequency groups. These frequency groups are selected in such a manner that an audibility of a disturbance may be excluded in accordance with psycho-acoustical findings if the signal energy within each individual frequency group is distinctly higher than the disturbance energy within the same frequency group or the disturbance energy is less than the absolute threshold of audibility in this frequency. For this purpose, following transformation, the signal energy for each frequency group is first calculated from the spectral coefficients, from which then the disturbance energy permissible is computed for each frequency group. The permissble value is the absolute threshold, which is i.a. proportional to the fixed value of the level control, or the so-called listening threshold, which is yielded by the multiplication of the signal energy by a frequency-dependent factor, depending on which value is higher.

Subsequently the spectral coefficients are quantized, encoded and reconstructed according to the process described in the preceding section. The disturbance energy, i.e., allowable noise, for each frequency group can be computed from the original data of the spectral coefficients and the reconstructed values. If the disturbance energy in a group is greater than the previously computed permissible disturbance energy in this group and this block, the values of this frequency group are increased by multiplication by a fixed factor in such a manner that the relative disturbance is proportionally less in this frequency group. Then renewed quantizing and encoding occurs. These steps are repeated iteratively until either the disturbance in all frequency groups is so relatively small that an audibility of the disturbances may be ruled or until, e.g. the process is discontinued after a certain number of iterations to shorten the computations or because improvement is no longer possible. It is to be noted that, in order to reflect the thresholds of audibility, the multiplication factors per frequency group have to be transmitted along as further additional information in encoding.

In order to reconstruct the data (with or without taking psycho-acoustical findings into consideration), the optimum encoded values have first to be decoded, by way of illustration by means of an associative memory into integers for the spectral coefficients and, if necessary, the small values and the values "=0" have to be supplemented. Then these are multiplied by the value computed with the multiplication factor transmitted along and an additional value, also computed, if necessary, with the tranmitted value for the spectral nonuniform distribution. Subsequently, only rounding off is required for reconstruction.

DESCRIPTION OF PREFERRED EMBODIMENTS

The present invention is made more apparent in the following section using two preferred embodiments without the intention of limiting the scope of the overall inventive idea.

Figure 1:
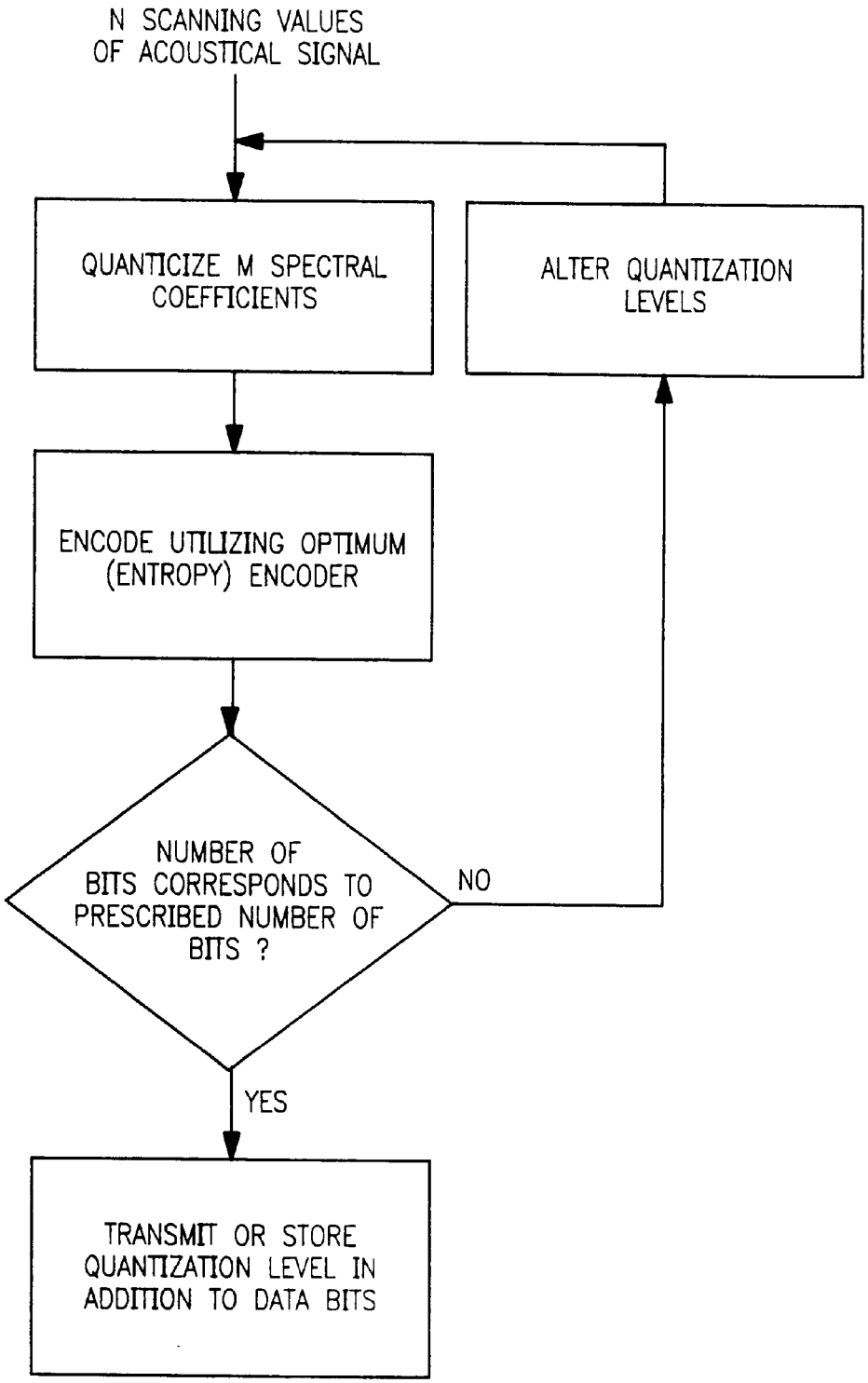
FIG. 1 is a flow diagram in accordance with the steps of a digital coding process of the invention.
Figure 2:
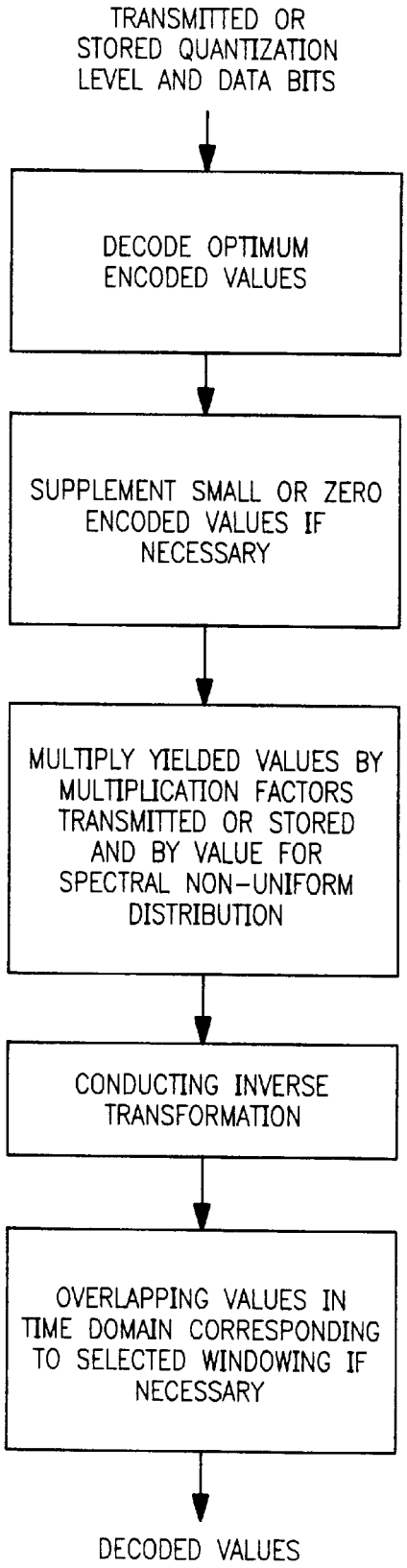
FIG. 2 is a further flow diagram illustrating further aspects of such digital coding process.

FIGS. 1 and 2 are illustrative.

In the following embodiments, for reasons of clarity, M=8; actually, however, M values of 256, 512 or 1024 typically would be selected.

Embodiment 1

In this embodiment the cosinus transformation is employed as transformation between the acoustical signal (time signal) and the spectral values, whereby N=M.

After the transformation of N (=M) scanning values of the acoustical signals in the spectral region with the discrete cosinus transformation, e.g. the following are values for the spectral coefficients:

−1151 66.4 1860 465 −288 465 −88.6 44.3

From this, first the spectral nonuniform distribution sfm with the equation is computed, yielding:

$$sfm=0.0045$$

The quantized value $sfm_q$ is computed from sfm according to the following formula:

$$sfm_q=int(1n(1/sfm)/1.8)=3$$

The transmitted along value $sfm_q$ lies in the value range 0–15 and, thus, can be represented with 4 bits.

Then the 1st quantization occurs in the frequency range, which, in the case of the selected preferred embodiment, is the division of the value of the respective spectral coefficients by the value $q_{anf}$:

$$q_{anf}=e^{(1.8*sfm_q)}=221$$

Furthermore, in order to take the psycho-acoustical findings into consideration, the spectral coefficients are divided into 3 groups:

| Coefficients | 1–2 | 3–4 | 5–6 |
|---|---|---|---|
| | $1.32*10^6$ | $3.68*10^6$ | $3.09*10^5$ |

and factors for the "permissible disturbances":

| | | |
|---|---|---|
| 0.1 | 0.1 | 0.5 listening threshold |
| 0.05 * last value | | masking by lower requencies are introduced. |

Thus as permissible disturbances are yielded:

$1.32*10^5$ $3.68*10^5+0.05*1.32*10^6=4.34*10^5$ $1.54*10^5+0.05*3.68*10^6=3.38*10^5$

In this manner, constant values have been computed for this block.

The first encoding attempt with the quantization level 221 yields:

−5.2 0.3 8.4 2.1 −1.3 2.1 −0.4 0.2 quantizied:

−5 0 8 2 −1 2 0 0

When encoding with the following entropy coder, 20 bits should be available for the selected embodiment:

| to be quantized | Value | Repres. | | Length | |
|---|---|---|---|---|---|
| 0 | 0 | 1 | 5 | 1111100 | 7 |
| 1 | 100 | 3 | −5 | 1111101 | 7 |
| −1 | 101 | 3 | 6 | 11111100 | 8 |
| 2 | 1100 | 4 | −6 | 11111101 | 8 |
| −2 | 1101 | 4 | 7 | 111111100 | 9 |
| 3 | 11100 | 5 | −7 | 111111101 | 9 |
| −3 | 11101 | 5 | 8 | 1111111100 | 10 |
| 4 | 111100 | 6 | −8 | 1111111101 | 10 |
| −4 | 111101 | 6 | | | |

Bits required for encoding are:

7 1 10 4 3 4 1 1

Thus, a total of 31 bits are needed for coding. The number of required bits, therefore, is greater than the available value. For this reason a second quantization attempt is made.

The second quantization level, in which, in the case of the selected embodiment, we divide by the number 2 and round off in the usual manner, yields as new values.

−3 0 4 1 −1 1 0 0

Bits needed for encoding:

5 1 6 3 3 3 1 1

Thus, a total of 23 bits are needed and, therefore, another quantization is necessary in order to remain under the (prescribed) representation length of 20 bits.

In the third quantization level, we divide once more by the number 2 and round off:

−1 0 2 1 0 1 0 0

Bits required for encoding these values:

3 1 4 3 1 3 1 1

The required number of bits is 17 and, thus, less than the prescribed value, therefore, the encoding is successful with regard to the number of bits. In order to check the usefulness of the encoding, the encoding is now checked by means of reconstructing the values on the transmission side:

Reconstruction:

Factor: 2*2*221=884

Reconstructed values:

−884 0 1768 884 0 884 0 0

Encoding error per coefficient (difference)

267 −66.4 −92 419 288 88.6 −44.3

Encoding error per frequency group (per sum $x^2$)

$7.57*10^4 1.84*10^5 2.68*10^5$

The encoding error is less in each frequency group than the permissble disturbance, therefore, the values in this level may actually be encoded and transmitted:

| | | |
|---|---|---|
| Level factor (norming prior to transformation) | | 4 bits |
| sfm | 3 | 4 bits |
| Number mult. for encoding | 2 | 5 bits |
| Number mult. outside loop (when disturbance energy was too great) | 0, 0, 0 | 3 * 3 bits |
| Encoded values: | 10101100100010000 | 17 bits (here) |

In the third quantization level, the transmitted values may now be transmitted or stored.

The side information to be transmitted is that the third encoding attempt was successful.

In the following the reconstruction of the encoded values is described:

(i) Reconstruction of the quantized values from the encoded bit sequences:

Results: −1 0 2 1 0 1 0 0

(ii) Division of each frequency group by the factor, as often as is given by the number of multiplications in the outer loop:

(Example: 2nd frequency group 1*)

Results: −1 0 2/3 1/3 0 1 0 0

(iii) Multiplication by the factor, as often as division was required in encoding:

(In the example 2*, as the assumed factor is 2):

Results: −4 0 8/3 4/3 0 4 0 0

(iv) From the quantized value of sfm (here 3), the first quantization level is computed again (here 221). The coefficients are multiplied by this value and rounded off (not shown here):

Results: −884 0 589 295 0 884 0 0

Thus, different values are yielded than those given at the outset as it was additionally assumed that the outer loop would be run through again, i.e. a correction (in the second frequency group) would be necessary.

(v) Inverse transformation (discrete cosinus transformation, not shown here).

(vi) Level control output portion (as also ATC)

(vii) Overlapping with previous block (output portion windowing)

Second Embodiment

The second preferred embodiment described in the following section has the additional feature that the individual blocks overlap by half a block length in order to reduce frequency cross-talk (aliasing). For this purpose the scanning values of the acoustical signals are mulitplied by a window function (analysis window) in an input buffer, coded, decoded on the reception side, and multiplied again by a window function (synthesis window) and the areas overlapping each other are added.

In the case of the preferred embodiment described in the following section, the "time domain aliasing cancellation" (TDAC) process is applied, in which the number of transmitted values equals the number of values in the time domain despite the window's overlapping by half a block length. For details on the TDAC process references is made, by way of illustration, to the literary source "Subband/Transform Coding Using Filter Bank Designs Based on Time Domain Aliasing Cancellation" in IEEE Proceeding of Intern. Conf. on Acoustic Speech and Signal Proceeding, 1987, pp. 2161ff.

The first 8 scanning values of the composed window for the acoustical signal are multplied by the following values (window function):

0.1736 0.3420 0.5 0.6428 0.7660 0.8660 0.9397 0.9848

Accordingly, the second 8 values of the window are multiplied by the "reflected" values of the window function.

The scanning values of the acoustical signal of the last data block may, by way of illustration, have the following values:

607 541 484 418 337 267 207 154 and those of the immediate data blocks:

108 61 17 −32 −78 −125 −174 −249

After multiplication by the afore-given window function with an overlapping of 8 values, the following values are yielded:

| | | | | | | | |
|---|---|---|---|---|---|---|---|
| 105.4 | 185.0 | 242.0 | 268.7 | 258.1 | 231.2 | 194.5 | 151.6 |
| 106.3 | 57.3 | 14.7 | −24.5 | −50.1 | −62.5 | −59.5 | −43.2 |

After applying the TDAC transformation algorithm to the "windowed" 16 values, one receives only 8 spectral values (M=8) instead of 16 scanning values (N=16) of the composed window:

43.49 170.56 152.3 −38.0 −31.4 −0.59 23.1 6.96

Now the equal share is subtracted. In the present embodiment, the quantized equal share is =0 as the first value of the frequency group is of the same magnitude as the other values.

From the spectral values gained by means of TDAC transformation, first the spectral nonuniform distribution sfm is computed again using the equation $$sfm = \left(\prod_{i=1}^{N} \sqrt{3_i^2}\right)^{\frac{1}{N}} \Big/ \sqrt{\frac{1}{N}\sum_{i=1}^{N} 3_i^2}$$

Yielded is:

$$sfm=0.2892$$

From the sfm, the quantized value $sfm_q$ is computed once more using the following equation:

$$sfm_q=int(1n(1/sfm)/1.8)=1$$

$$q_{amf}=6.05$$

In this embodiment, it should be assumed that the number of bits is 25.

In the first quantization level, the spectral values are divided by $q_{amf}$=6.05, yielding:

7.18 28.20 25.17 −6.28 −5.19 −0.097 3.8 1.15 or quantizied:

7 28 25 −6 −5 0 4 1

The number of bits required to represent these values in the entropy decoder employed in the first embodiment is—as may be distinctly seen—greater than the prescribed number of bits. Moreover, there are values which exceed the range of the entropy coder. This functions as the criteria that further quantization is necessary.

Thus, a second quantization attempt is made, in which division is by 2*6.05, yielding:

| | | | | | | | |
|---|---|---|---|---|---|---|---|
| 3.59 | 14.09 | 12.59 | −3.14 | −2.59 | −.048 | 1.90 | .575 |
| 4 | 14 | 13 | −3 | −3 | 0 | 2 | 1 |

In this step, too, the number of bits or the range of the entropy coder is exceeded, therefore, a third quantization attempt is made, in which division is by 2*2*6.05, yielding:

| | | | | | | | |
|---|---|---|---|---|---|---|---|
| 1.79 | 7.04 | 6.29 | −1.57 | −1.29 | −.024 | .95 | .28 |
| 2 | 7 | 6 | −2 | −1 | 0 | 1 | 0 |

Now the number of bits with the entropy coder prescribed in the first embodiment is:

4 9 8 4 3 1 3 1

The total number of required bits is 33 and thus exceeds the prescribed range:

In the fourth step, division is by 2*2*2*6.05, yielding:

| | | | | | | | |
|---|---|---|---|---|---|---|---|
| .90 | 3.52 | 3.14 | −.78 | −.65 | −.012 | −.48 | .14 |
| 1 | 4 | 3 | −1 | −1 | 0 | 0 | 0 |

For coding, the following number of bits were required:

3 6 5 3 3 0 0 0

The total number of bits was 23 and, thus, lay in the prescribed range.

The further mode of procedure is analogue to the one described in connection with the first embodiment.

In addition, the following must be pointed out:

If the values here, which equal 0, are counted extra from high frequencies (here 33*0) and are not transferred individually, 20 bits already suffice.

As in the case of the first embodiment, now reconstruction follows in order to check the quantization error:

For this purpose, the encoded values are multiplied by the factor:

$2^3$*6.05=48.397

Yielded are the following values:

48.39 193.59 145.19 −48.39 −48.39 0 0 0

Thus, the coding error of the individual spectral coefficients are:

−4.9 23 −7.11 10.39 16.99 −0.59 23.1 6.96

Thus yielding as error per frequency group ($\Sigma x^2$)

| | | |
|---|---|---|
| 553 | 158.5 | 289.00 |
| (1–2) | (3–4) | (5–6) |

As in the case of the preceeding embodiment, the "permissible disturbance" (i.e., allowable noise) is computed:

| Energy: coeff. | 1–2 | 3–4 | 5–6 |
|---|---|---|---|
| | 30982 | 24639 | 986 |

The factors for the permissible disturbances, which are computed in the same manner as in the preceeding embodiment, are:

| | | |
|---|---|---|
| 0.1 | 0.1 | 0.1 |
| + | 0.05 * the last value | 0.005 * the last value |

This yields in this embodiment:

| |
|---|
| 3098.2 |
| 2463.9 + .05 * 3098.2 = 2618.8 |
| 493 + .05 + 2463.9 = 616.2 |

The permissible disturbance was by no means exceeded.

The reconstruction (decoder) is briefly described in the following section:

(i) Reconstruction of the quantized values Huffman decoder: (example)

Bit current:

| | | |
|---|---|---|
| 0001 | 0011 | 10011110011100101101000xx |
| 4 bits | 4 bits | 25 bits |
| for $sfm_q$ = 1 | for number multiplic. | for spectral coefficients |

The code is selected in such a manner that no word is the first word of another (FANO condition, known from literary sources). for this reason, the quantized values from the bit current may be regained with the possible code words:

| | |
|---|---|
| $sfm_q$ = 1 | β $q_{amf}$ = 6.05 |
| Number mult. = 3 | β quant. level = 6.05 * $2^3$ |
| | = 48.397 |

The quantized spectral values are:

1 4 3 −1 −1 0 0 0

These values are divided by the correction error of the outer loop—in this embodiment always 1—and then multiplied by the "quantization level" (48.39), yielding:

48.39 193.59 145.19 −48.39 −48.39 0 0 0

After inverse transformation 16 values are gained again:

| | | | | | | | |
|---|---|---|---|---|---|---|---|
| −56.42 | −11.35 | 7.20 | 2.57 | −2.57 | −7.20 | 11.35 | 56.42 |
| 61.45 | −2.47 | −62.24 | −73.30 | −73.30 | −62.24 | −2.47 | 61.45 |

These values are windowed with the same window function like with the transmitter, yielding:

| | | | | | | | |
|---|---|---|---|---|---|---|---|
| −9.79 | −3.88 | 3.60 | 1.65 | −1.96 | −6.23 | 10.66 | 55.5 |
| 60.5 | −2.3 | −53.9 | −56.1 | −47.1 | −31.1 | −.05 | 10.67 |

The yielded values from the last step (last 8 values) are stored in an intermediate memory.

615.0 544 478.6 411.2 345.1 276.3 198.1 108.4

These values are "overlapped" with the first 8 values, i.e. the values are added. The results, i.e. the time signal is yielded by adding the first 8 values to the values in the intermediate memory:

605.2 540.1 475 409.55 343.14 270.07 208.76 163.9

The second 8 values are stored in the intermediate memory.

For comparison the input values are given:

607 541 484 418 337 267 207 154

The excellent conformity of the original data and the reconstructed data is immediately evident.

The present invention is described in the preceeding section with reference to preferred embodiments without the intention of limiting the scope and spirit of the overall inventive idea. Naturally, there are many possible variations and modifications within the scope and spirit of the overall inventive idea:

Quantization does not have to occur by means of dividing by a value and subsequently rounding off to an integer value. Non-linear quantization is, of course, also possible. This can ensue, by way of illustration, by comparison with a table. The possibility of logarithmic and Max quantization are mentioned by way of example. It is also possible to first conduct a pre-distortion followed by a linear quantization.

Furthermore, an encoder, whose design is adapted to the statistics of the acoustical signals to be transmitted, may be employed as optimum encoder.

Finally, it is to be pointed out that typical real values may be very different from the values used. As an example of real values are:

| | | |
|---|---|---|
| Block length: | | 512 values |
| Window length: | | 32 values |
| Number of frequency groups: | | 27 |
| Side information: | Level control | 4 bits |
| | sfm | 4 bits |
| | Mult. factor coder | 6 bits |
| | Mult. fact. frq. gr. | 27 * 3 bits |
| | Number value = 0 | 9 bits |
| | Number value β 1 | 9 bits |

Mult. factor coder 1.189=sqrt (sqrt (2)) Mult. factor freq. groups 3.

The invented process may be realized with a signal processor. Thus a detailed description of the circuit realization may be dispensed with.

Accordingly, the present invention is seen to provide a digital coding process for the transmission and/or storage of acoustical signals and, in particular, of musical signals, in which N scanning values of the acoustical signal are transformed into M spectral coefficients, where N and M are integers,_comprising the following steps:

the M spectral coefficients are quantized in a first step, encoding utilizing an optimum encoder to provide a number of bits representing the quantized spectral coefficients, checking the number of bits, if said number of bits does not correspond to a prescribed number of bits, selecting from a finite number of available quantization levels an altered quantization level, then repeating quantization and encoding in additional steps using said altered quantization level until the number of bits required for representation reaches the prescribed number of bits, and transmitting or storing the required quantization level and in addition to the data bits.

A process for decoding acoustical signals which were encoded utilizing the foregoing process comprises the following steps:

decoding the optimum encoded values in the quantized integers for the spectral coefficients, supplementing small or zero values if necessary, multiplying the yielded values by multiplication factors, which were transmitted along, if necessary, as well as by the value for spectral non-uniform distribution, conducting inverse transformation, and overlapping, if necessary, the values in the time domain corresponding to selected windowing.

What I claim is:

1. A digital coding process for the transmission and/or storage of acoustical signals, preferably musical signals, in which N scanning values of the acoustical signals are transformed blockwise into M spectral coefficients, where N and M are integers, comprising the following steps:

calculating by means of a calculation unit a spectral nonuniform distribution from the spectral coefficients M;

determining by means of the calculation unit an initial value for a level of quantization for all M spectral coefficients;

quantizing by means of a quantization unit all M spectral coefficients for obtaining integer values corresponding to the quantized values of the M spectral coefficients;

An optimum encoder encodes the quantized values of the M spectral coefficients;

encoding by means of an optimum encoder the quantized values of the M spectral coefficients for providing a number of data bits representing the quantized spectral coefficients;

checking by means of a control unit the number of data bits;

wherein:

if the overall length of said encoded data is greater than the number of bits available or this bloc, raising the quantization level and conducting encoding again, said raising of the quantization level being continued until the overall length of thus encoded data is equal or less than of the number of bits available for this block; and transmitting and/or storing by means of a transmitting or storing unit the final quantization level in addition to the data bits.

2. A signal processor-implemented process according to claim 1, wherein the final quantization level is one in which said number of data bits corresponds to a prescribed number of data bits.

3. A signal processor-implemented process according to claim 1 wherein the optimum encoder comprises an entropy encoder.

4. A signal processor-implemented process according to claim 1, whereby said encoding uses a code table in each step according to statistical properties of said quantized spectral values.

5. A signal processor-implemented process according to claim 1, wherein the step of quantizing is carried out by utilizing a "Max quantizer".

6. A signal processor-implemented process according to claim 1, wherein the transform used in transforming said N scanning values comprises a Discrete Cosine Transformation, a transform using Time Domain Aliasing Cancellation or a Discrete Fourier Transform.

7. A signal processor-implemented process according to claim 1, and further comprising the steps of computing an estimate of the threshold of audibility of quantization errors according to psycho-acoustical findings, multiplying groups of spectral values by scale factors, reconstructing spectral values from said quantized spectral values multiplied by scale factors, computing the actual quantization noise, comparing the actual quantization noise with said threshold of audability, and then repeating the steps of multiplying by scale factors, quantization, coding, reconstructing, computing of quantization noise and comparing, using adjusted scale factors.

8. A signal processor-implemented process for decoding acoustical signals, which were encoded utilizing a process defined in claim 1, comprising the following steps:

decoding from the transmitted or stored signal the data bits representing the quantized spectral coefficients multiplying the values produced by the decoding step by said scale factors, and conducting an inverse transform of the values produced by said multiplying step.

* * * * *